US009309660B2

(12) United States Patent
Stein

(10) Patent No.: US 9,309,660 B2
(45) Date of Patent: Apr. 12, 2016

(54) COUNTERACTING UPLIFT IN BUILDING SUPERSTRUCTURES

(76) Inventor: Alejandro Stein, Crans-Pres-Celigny (CH)

( * ) Notice: Subject to any disclaimer, the term of this patent is extended or adjusted under 35 U.S.C. 154(b) by 0 days.

(21) Appl. No.: 13/507,289

(22) Filed: Jun. 19, 2012

(65) Prior Publication Data

US 2013/0333322 A1 Dec. 19, 2013

(51) Int. Cl.
*E04B 1/10* (2006.01)
*E04B 1/18* (2006.01)
*E04B 2/70* (2006.01)

(52) U.S. Cl.
CPC . *E04B 1/18* (2013.01); *E04B 2/702* (2013.01); *Y10T 403/55* (2015.01)

(58) Field of Classification Search
CPC ..... E04B 2/702; E04B 2/705; E04B 1/18; Y10T 403/55
USPC ..... 52/233, 284, 587; 403/326, 382
See application file for complete search history.

(56) References Cited

U.S. PATENT DOCUMENTS 2,112,247 A * 3/1938 McLoughlin ..... 446/116
3,811,154 A * 5/1974 Lindeman et al. ..... 24/326
3,919,819 A * 11/1975 Oliver ..... 52/233
3,969,859 A * 7/1976 Hisey ..... 52/233
4,422,222 A * 12/1983 Notoya ..... 24/614
4,619,089 A * 10/1986 Stein ..... 52/233
4,674,910 A * 6/1987 Hayashi ..... 403/408.1
4,683,622 A * 8/1987 Oehlke ..... 24/458
4,781,488 A * 11/1988 Hayashi ..... 403/408.1
4,830,536 A * 5/1989 Birch et al. ..... 405/153
5,020,289 A * 6/1991 Wrightman ..... 52/233
5,282,343 A * 2/1994 Stein ..... 52/233
5,716,161 A * 2/1998 Moore et al. ..... 403/326
5,799,452 A * 9/1998 Moore ..... 52/233
5,881,515 A * 3/1999 George ..... 52/233
5,992,953 A * 11/1999 Rabinovitz ..... 312/111
6,394,695 B1 * 5/2002 Chausset ..... 403/397
6,676,326 B2 * 1/2004 Wu ..... 403/329
6,718,599 B2 * 4/2004 Dickinson et al. ..... 24/295
6,904,728 B2 * 6/2005 Stutts ..... 52/233
7,017,239 B2 * 3/2006 Kurily et al. ..... 24/297
7,188,392 B2 * 3/2007 Giugliano et al. ..... 24/295
7,398,622 B2 * 7/2008 Walker ..... 52/204.69
8,074,413 B2 * 12/2011 Stein ..... 52/233
2010/0281799 A1 * 11/2010 Stein ..... 52/293.1

OTHER PUBLICATIONS

Building. (n.d.). Dictionary.com Unabridged. Retrieved Feb. 27, 2014, from Dictionary.com website: http://dictionary.reference.com/browse/building.*

* cited by examiner

*Primary Examiner* — Basil Katcheves
*Assistant Examiner* — Joshua Ihezie
(74) *Attorney, Agent, or Firm* — Donald S. Dowden

(57) ABSTRACT

An assembly comprises a first connector attached to a first hollow metal log of a building superstructure; a latch; and a second connector attached to a second hollow metal log of the superstructure. The first connector comprises a slot for receiving a projecting flange of the latch, and the second connector comprises an opening adapted to receive a cam portion of the latch. The projecting flange can be pre-engaged with the slot to form a preassembly. The engagement of the cam with the opening formed in the second connector then forms a final assembly wherein the first connector, the latch, and the second connector are latched together so that the first and second logs are interconnected and made resistant to wind uplift.

1 Claim, 6 Drawing Sheets

COUNTERACTING UPLIFT IN BUILDING SUPERSTRUCTURES

BACKGROUND OF THE INVENTION

1. Field of the Invention

This invention relates to building superstructures and, more particularly, to a novel and highly effective structural assembly and construction method for the rapid and inexpensive construction of lightweight building superstructures that are resistant to uplift, as from wind or inertial forces.

2. Description of the Prior Art

Among the leading disclosures of hollow metal log building construction are applicant's U.S. Pat. No. 4,619,089 for "Building Structure," issued October 28, 1986, and U.S. Pat. No. 5,282,343, for "Building Structures, Elements and Methods for Constructing Same," issued Feb. 1, 1994, and corresponding patents issued in other countries. The disclosures of the '089 and '343 patents identified above are incorporated herein by reference. The structures and methods developed by the applicant are believed to be the current state of the art relevant to the present invention.

Structures made in the ways previously developed by the applicant are suited for any location but especially for remote sites, possibly off the power grid, in areas with less developed economies, where rapid and inexpensive construction of small- to medium-sized houses, schools, storage sheds, commercial and community buildings, government and private office buildings and similar structures is a priority. Applicant's inventions have found wide and growing acceptance by public and private interests in many countries around the world.

Wind uplift is a problem in small- to medium-sized building superstructures of various designs, particularly if, as is often the case, they have eaves that extend out beyond the supporting walls. To the extent that air pressure on the underside of the eaves exceeds the pressure on the topside, there is a net upward force that can blow part or all of the roof off the walls. Even in the absence of eaves, wind can produce a Bernoulli Effect causing air pressure above the roof of a building to be less than the air pressure within the building and generating a dangerous uplift.

The problem of wind uplift is especially severe in inexpensive superstructures made not of solid wood or other heavy material but of sheet metal rolled into hollow metal "logs." Such logs can be shipped inexpensively to a building construction site as flat sheets and formed into hollow logs onsite. But since superstructures comprising hollow metal logs are lightweight compared to most other designs, they are especially susceptible to wind uplift.

Indeed, the logs of such buildings are so light that, without suitable tie-downs, individual logs in a wall or even entire walls can be detached and blown away with the roof by winds of considerably less than hurricane force.

Inertial forces, as from earthquakes, can also generate uplift. If the ground under a building alternately rises and falls, conservation of momentum (initially zero relative to the earth) can cause the building to experience an upwardly directed inertial force that tends to separate the superstructure from the foundation, upper parts of walls from lower parts, or the roof from the walls.

In superstructures made of hollow metal logs, the problem of uplift due to whatever natural cause is conventionally addressed by attaching metal rods to the building foundation at building corners. Each rod extends vertically through connectors that connect horizontally extending adjacent logs forming the walls of the superstructure. The rods run the full height of the walls and are connected at their tops to the roof to serve as tie-downs.

Of course, this solution involves incremental costs of time and labor, which it is desirable to avoid. Of greater concern, workers who are poorly trained or inadequately supervised may omit the installation of the metal rods. Since the rods are not visible in the finished construction, the omission may go unnoticed until a high wind, an earthquake, or another cause of uplift damages or destroys the building.

OBJECTS AND SUMMARY OF THE INVENTION

An object of the invention is to provide a better solution to the problem of uplift due to any natural cause, especially such uplift affecting lightweight building superstructures.

Other objects of the invention include providing a structural assembly and method of using it that:

- is inexpensive;
- enables rapid construction of building superstructures;
- is suited for any location but especially for remote sites, possibly off the power grid, in areas with less developed economies;
- does not require skilled labor; and
- makes it practically impossible to omit the tie-down function.

The foregoing and other objects are attained by providing a novel assembly adapted for use in a building superstructure. The assembly comprises first connecting means adapted for attachment to a first part of a building superstructure, such as a hollow metal log; latching means; and second connecting means adapted for attachment to a second part of a building superstructure, such as another hollow metal log. In accordance with the invention, the first connecting means comprises a first portion adapted for preliminary engagement with a first portion of the latching means, and the second connecting means comprises a second portion adapted for final engagement with a second portion of the latching means.

The preliminary engagement forms a preliminary assembly (preassembly) wherein the first connecting means and the latching means are latched together, and the final engagement forms a final assembly wherein the first connecting means, the latching means, and the second connecting means are latched together. The first and second parts of the building superstructure can thus be interconnected and made resistant to uplift.

Various additional features characterize the preferred embodiment of the invention:

- As disclosed in the drawings attached hereto, the assembly is mounted in a wall of a building superstructure with the first connecting means above the second connecting means. However, as explained below, with suitable modification the second connecting means can be mounted above the first connecting means.
- The latching means has an unloaded configuration before the preliminary engagement of the first portion thereof with the first portion of the first connecting means, a compressed configuration during the preliminary engagement and final engagement, and, in the preassembly and in the final assembly, a latching configuration intermediate the unloaded and compressed configurations. The latching means in the preassembly and final assembly is biased towards the unloaded configuration.
- One of the first portion of the first connecting means and the first portion of the latching means comprises a first receiving space such as a slot and the other of the first portion of the first connecting means and the first portion of the latching means comprises a first extension such as a flange. In the preassembly and the final assembly, the first extension is received within the first receiving space.

In addition, one of the second portion of the second connecting means and the second portion of the latching means comprises a second receiving space such as a slot and the other of the second portion of the second connecting means and the second portion of the latching means comprises a second extension such as a flange. In the final assembly, the second extension is received within the second receiving space.

The first and second extensions extend in parallel directions. In forming the preassembly, the first connecting means and the first latching means are moved relative to each other in a direction perpendicular to the parallel directions so that the first extension is received within the first receiving space. Then, in forming the final assembly, the preassembly and the second connecting means are moved relative to each other in said perpendicular direction so that the second extension is received within the second receiving space.

In the best mode of practicing the invention, the second receiving space is formed as a relatively large opening having a substantial vertical dimension, and the second portion of the latching means comprises a cam at the top of which the second extension is located. The cam is constructed so that, in forming the final assembly, the cam engages a wall of the second connecting means and forces the latching means towards a compressed configuration without fully disengaging the first extension from the first receiving space. The cam then drops into the large opening. This seats the second extension, reseats the first extension, and completes the final assembly.

In accordance with another aspect of the invention, a method of erecting a building superstructure at a selected site comprises the steps of attaching first connecting means to a first part of a building superstructure and attaching second connecting means to a second part of the building superstructure. The first connecting means is formed with a first portion adapted to receive a first portion of a latching means, and the second connecting means is formed with a second portion adapted to receive a second portion of the latching means. The first portion of the latching means is pre-engaged with the first portion of the first connecting means to form a preassembly. The second portion of the latching means is then engaged with the second portion of the second connecting means to form a final assembly wherein the first connecting means, the latching means, and the second connecting means are latched together and the first and second parts of the building superstructure are interconnected and made resistant to uplift forces.

Preferably, the attaching and engaging steps are performed onsite, and the forming steps are performed offsite. The pre-engaging step can be performed onsite or offsite.

BRIEF DESCRIPTION OF THE DRAWING

A better understanding of the objects, features and advantages of the invention can be gained from the following detailed description of its preferred embodiments, in conjunction with the appended figures of the drawing, wherein.

DETAILED DESCRIPTION OF THE PREFERRED EMBODIMENTS OF THE INVENTION

Figure 1:
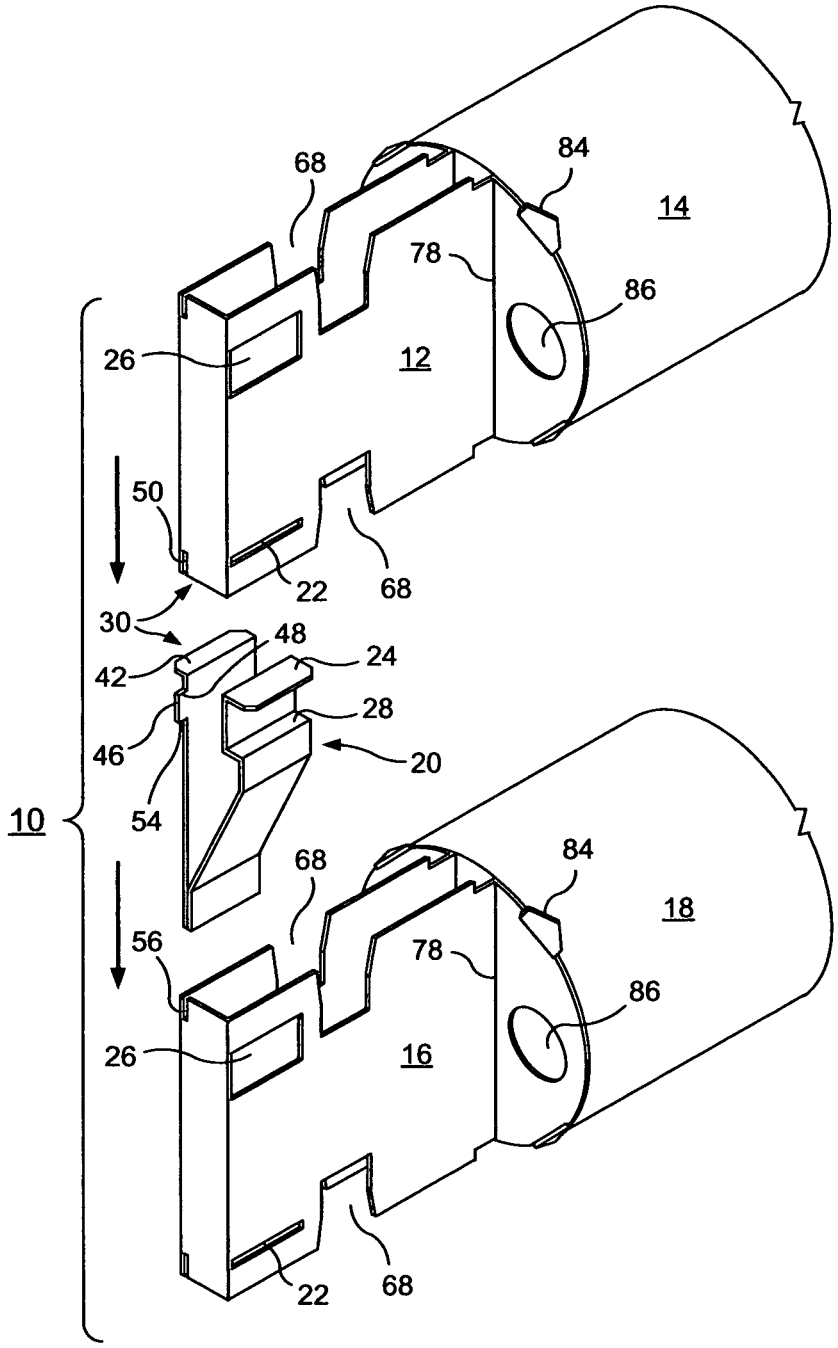
FIG. 1 is an exploded perspective view of first and second (upper and lower) connectors respectively attached to first and second hollow metal logs forming part of a wall of a building superstructure, and a hook positioned between the connectors for latching first to the upper connector to form a preassembly and then to the lower connector to form a final assembly.
Figure 2:
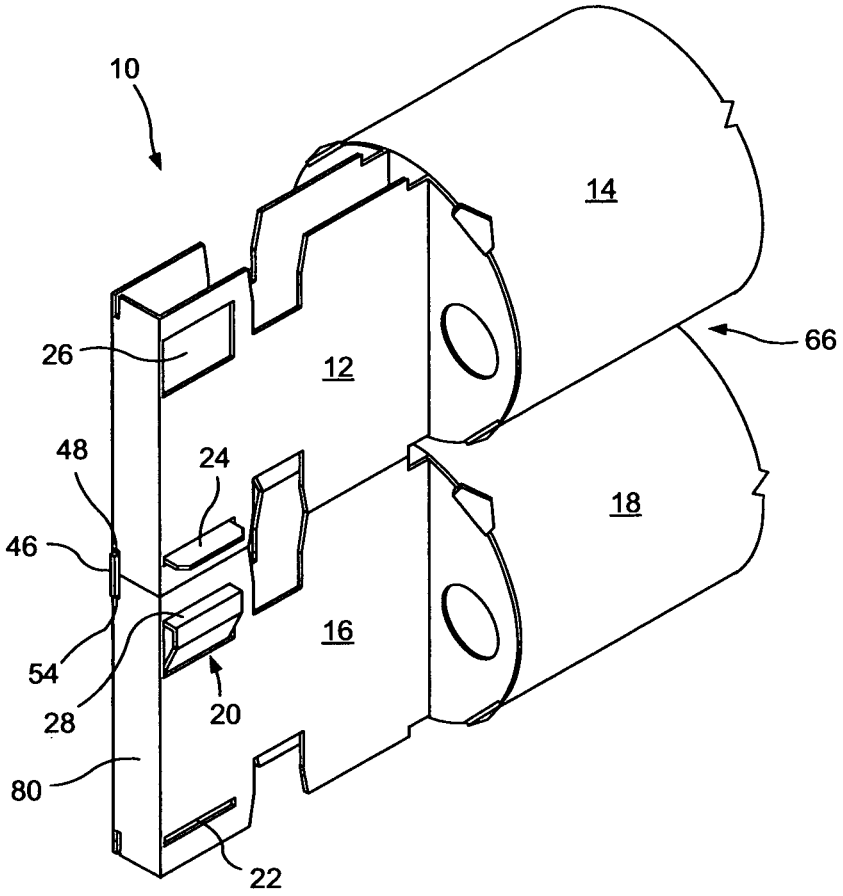
FIG. 2 is a perspective view corresponding to FIG. 1, showing the final assembly.
Figure 5:
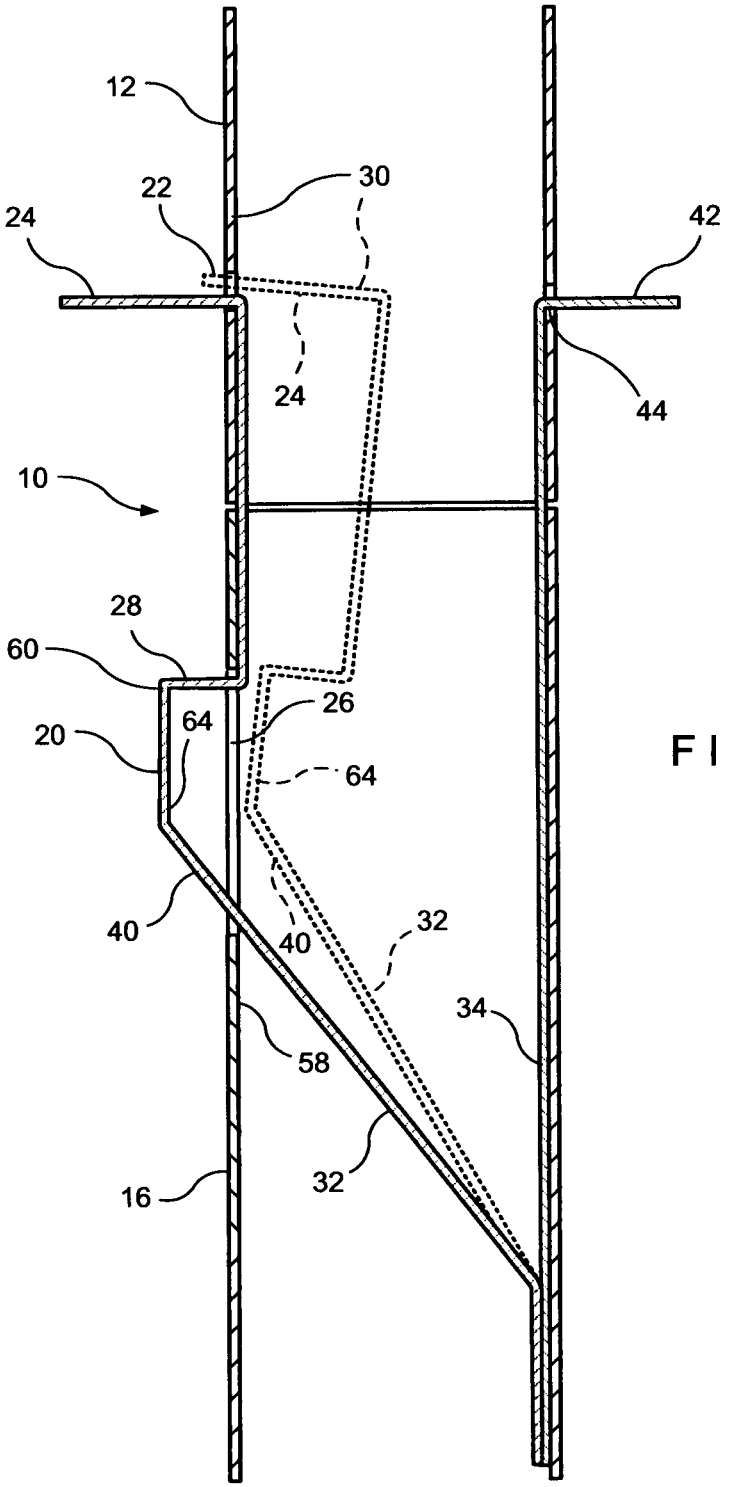
FIG. 5 is a view in a vertical section looking from the right to the left of FIG. 2, showing two connectors and a hook in a latched configuration and, in dotted lines, in a compressed configuration.

FIGS. 1, 2 and 5 show an assembly 10 adapted for use in a building superstructure. The assembly 10 comprises first connecting means such as an upper connector 12 adapted for attachment to a first part of a building superstructure such as a hollow metal log 14. Second connecting means such as a lower connector 16 is adapted for attachment to a second part of the building superstructure, such as a hollow metal log 18. Latching means such as a hook 20 is inserted between the upper and lower connectors 12 and 16.

The upper connector 12 comprises a first portion, such as a first slot or other first receiving space 22, adapted for preliminary engagement with a first portion, such as a first flange or other first extension 24, of the hook 20.

The lower connector 16 comprises a second portion, such as a second slot or other second receiving space 26, adapted for final engagement with a second portion, such as a second flange or other second extension 28, of the hook 20. The slot 26 is large compared with the slot 22 and has a substantial vertical dimension.

The preliminary engagement of the upper connector 12 and the hook 20 forms a preassembly 30 (FIG. 1) comprising those two parts.

The final engagement forms a final assembly 10 wherein the first connector 12, the hook 20, and the second connector 16 are latched together, as shown in FIG. 2. In the final assembly 10, the upper and lower logs 14 and 18 of the building superstructure are interconnected through the connectors 12 and 16 and the hook 20 and made resistant to uplift forces.

After the preassembly 30 is formed, all that is necessary to form the final assembly 10 is to lower the preassembly 30 onto the lower connector 16 until the hook 20 snaps onto the lower connector 16, as described below.

Figure 6:
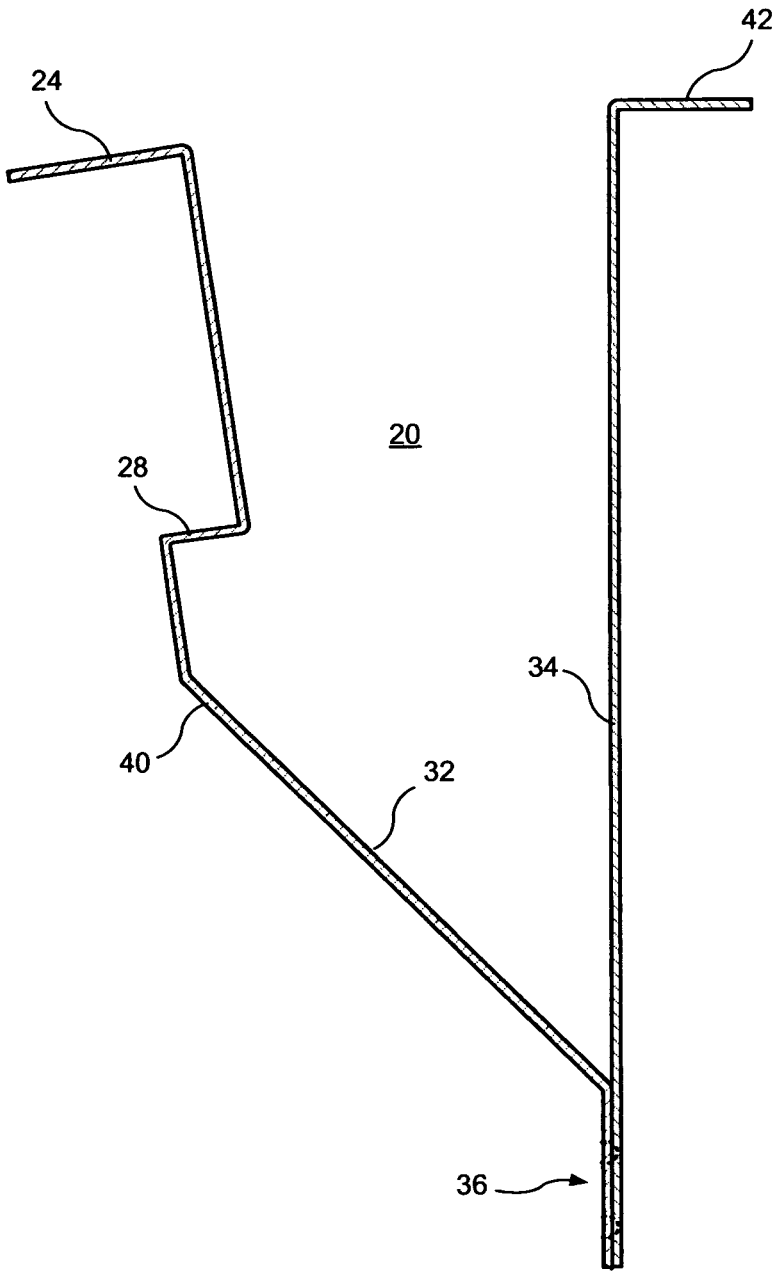
FIG. 6 is a view of the hook in vertical section looking from right to left, showing the hook in an unloaded configuration, before its engagement with either connector.

FIG. 6 shows the hook 20 in its unloaded configuration, before its preliminary engagement with the upper connector 12. The hook 20 is made of a springy material, preferably steel or another metal, though it could be made of a nonmetal such as a springy plastic, and comprises front and back plates 32 and 34 joined at a bottom portion 36 by rivets, welding, or in any other suitable manner. The hook 20 can also be fashioned out of a single piece of material (not shown), so that a separate joining step is unnecessary. The hook 20 is preferably formed with a curve or angle (not shown) at the bottom to facilitate its penetration in the connector element underneath.

Above the bottom portion 36, the front and back plates 32 and 34 are spaced apart from each other. If the front and back plates 32 and 34 are planar, they may form an angle with each other, such as 45 degrees, in the unloaded configuration. This enables portions of the front and back plates 32 and 34 that are spaced apart from the bottom portion 36 to move towards each other during forming of the preliminary and final assemblies 30 and 10. The springy property of the material biases the portions of the front and back plates 34 and 35 that are spaced apart from the bottom portion 36 away from each other. As described below, this prevents the hook 20, once latched in place, from becoming unlatched.

FIG. 5 shows in dotted outline the hook 20 moved towards a compressed configuration. The compression of the hook 20 must be enough to enable formation of the preliminary and final assemblies 30 and 10. The required compression is greatest during formation of the preassembly, since the compression must be sufficient to accommodate both flanges 24 and 42 inside the upper connector 12 until both are seated in their respective slots or other receiving spaces 22 and 44. There is thus an ultra compressed configuration (not shown) in which both flanges 24 and 42 are contained within the upper connector 12 but neither is seated in the respective receiving spaces 22 and 44.

During the preliminary engagement of the hook 20 with the upper connector 12 to form the preassembly 30, the hook 20 is compressed so that it can be inserted into the upper connector 12 and into the rear slot 44. The angle the front and back plates 32 and 34 form with each other in a compressed configuration is variable but clearly smaller than the angle they form in the unloaded configuration shown in FIG. 6.

FIG. 5 shows the final latched configuration of the hook 20 in solid outline. In that configuration, the front and back plates 32 and 34 form an angle that is larger than the angle they form in a more compressed configuration but smaller than the angle they form in the unloaded configuration. Or, more generally, the spacing between parts of the front and back plates 32 and 34 that are spaced apart from the bottom portion 36 of the hook 20 is greatest in an unloaded configuration, least in a compressed configuration, and intermediate in a latched configuration.

In the latched configuration (final assembly 10), the first receiving space or slot 22 receives the first extension or flange 24, and the second receiving space or slot 26 receives the second extension or flange 28, which is the top surface of a contoured structure that also includes a portion formed as a cam 40.

In addition to the outward- and rearward-directed horizontal flange 42 that in the preassembly 30 and the final assembly 10 is received in the horizontal slot 44 formed in the rear of the upper connector 12, as described above, the back plate 34 is further formed with a vertical flange 46 (FIG. 1). The flange 46 has an upper portion 48 that in both the preassembly and the final assembly is received in a vertical slot 50 formed in a bottom portion of the upper connector 12. The vertical flange 46 also has a lower portion 54 that in the final assembly is received in a vertical slot 56 formed in an upper portion of the lower connector 16. By thus engaging both connectors 12 and 16, it ensures their correct vertical alignment.

Because the hook 20 is made of a springy material, it pushes outwardly against opposite sides of the connectors 12 and 16 and retains the flanges 24, 28 and 42 securely in the respective slots or openings 22, 26 and 44.

Preferably, the Hook's Modulus of the material of which the hook 20 is made is selected so that compression of the hook 20 in forming the preassembly 30 and final assembly 10 can be effected manually. This obviates the use of special tools for that purpose and minimizes the need for skilled labor.

As FIG. 5 best shows, when the preassembly 30 is lowered onto the lower connector 16, the front side 58 of the lower connector 16 engages the cam surface 40 on the front plate 32 of the hook 20. This forces the hook 20 from the latched configuration of the preassembly 30 to a compressed configuration as indicated in solid and dotted outlines in FIG. 5. The first or front flange 24 partially withdraws from the first or front slot 22, but the design is such that a shoulder 60 above the cam 40 and at the outer edge of the flange 28 drops into the second receiving space or opening 26 before the flange 24 is fully withdrawn from the slot 22. When the cam shoulder 60 drops into place to seat the second flange 28 as described above, the first flange 24 is reseated in the slot 22.

The cam 40 has a portion 64 just below the flange 28 that in a compressed configuration has a reverse slope, as shown in FIG. 5 in dotted outline. The reverse slope portion 64 enables the hook 20 to begin its movement towards the latched configuration before the shoulder 60 drops into the slot 26. This reduces the snap throw, softens the landing of the hook 20 in the latched configuration, and makes installation process less noisy and tiring to the workers.

FIG. 2 shows the hollow metal logs 14 and 18 as forming part of a wall 66 of a building superstructure. Their respective connectors 12 and 16 are formed with cutouts 68 (FIGS. 1 and 3) that enable identical connectors (not shown) to be interfitted with the connectors 12 and 16 for support of logs (not shown) extending at right angles to the logs 14 and 18. In accordance with the invention, the identical connectors are latched by hooks identical to the hook 20.

Figure 3:
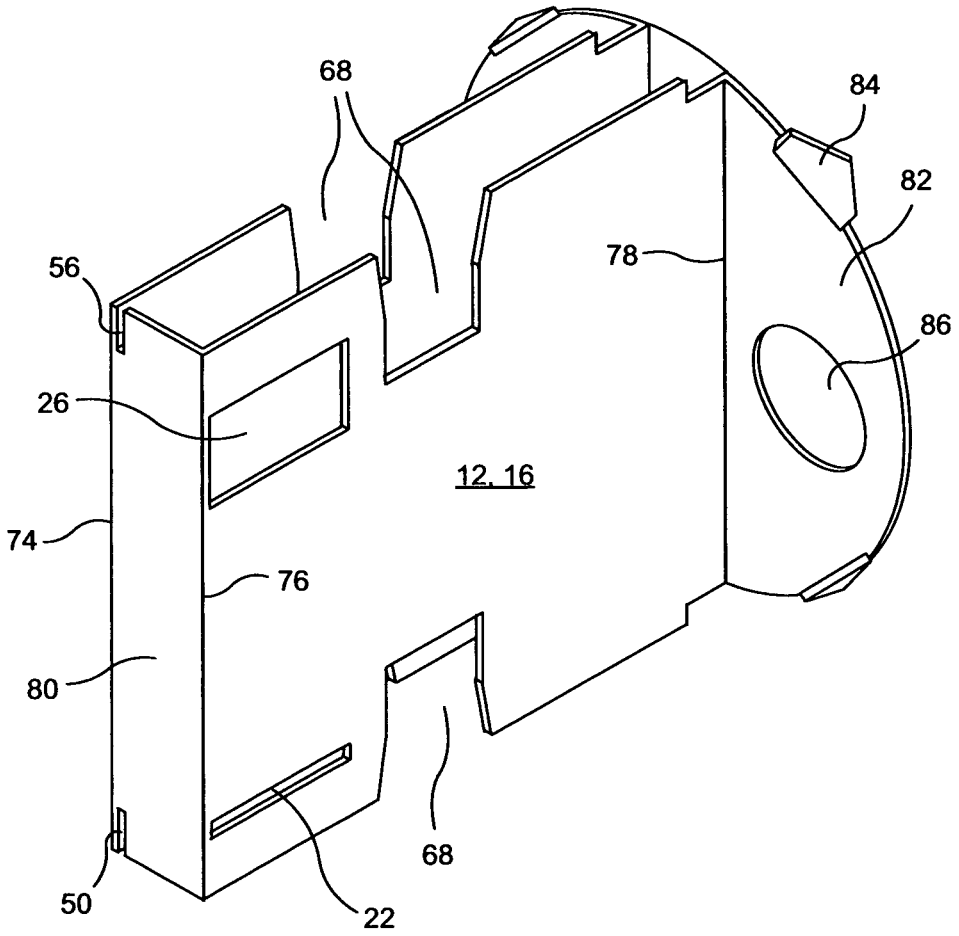
FIG. 3 is a perspective view of a connector.

FIG. 3 shows a connector 12 or 16. If it is in any position except at the very top or bottom of a wall, a hook above it latches through the opening 26 and slot 56, and a hook below it latches through the slots 22, 44 (FIGS. 5) and 50.

The walls of a superstructure can be raised to a desired height using identical connectors and identical hooks at each corner where walls meet, as described above. This modular construction means that unskilled labor can select any connector and any hook as work proceeds. If a given wall section has n logs, each of its ends will have n connectors and n-1 hooks. The bottom logs can be secured to the building foundation and the top logs to the building roof in any conventional manner.

Figure 4:
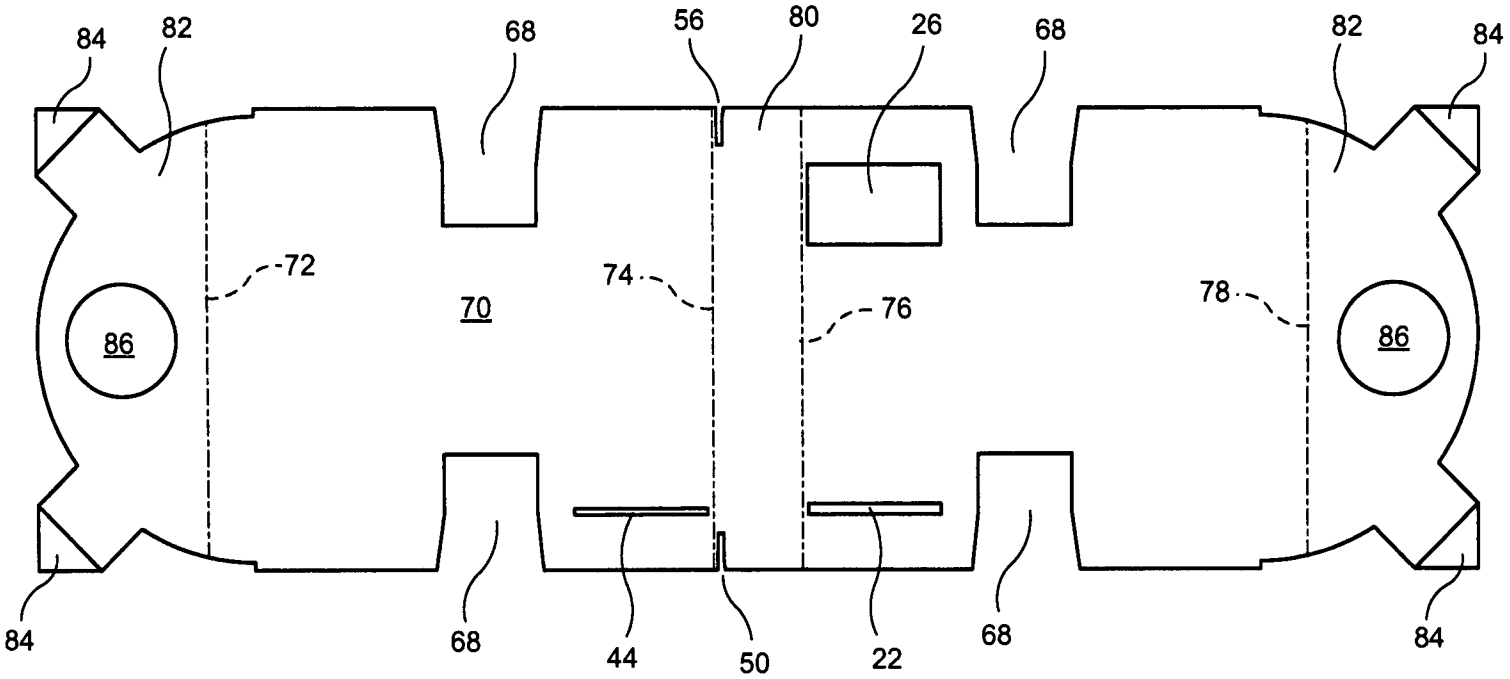
FIG. 4 is a plan view of a flat metal sheet that can be folded to form a connector.

FIG. 4 shows a blank 70 for making a connector 12 or 16. The blank 70 has fold lines 72, 74, 76 and 78. The blank 70 is folded at right angles into or out of the plane of FIG. 4 along the fold lines 74 and 76. A base portion 80 is between the fold lines 74 and 76. Given folds along the fold lines 74 and 76 as described above, the blank is folded along the fold lines 72 and 78 so that ends 82 are parallel to the base 80 and to the plane of FIG. 4.

The outer circumference of the ends 82 then form a near circle and are inserted into a log. Tabs 84 are peened over the ends of the log to secure the connector to the log. Holes 86 enable introduction of insulation to the interior of the log and egress of air during that process.

In the final assembly 10, the first flange 24, the second flange 28, the latter formed above the cam 40, and the rearward-directed flange 42 extend horizontally—i.e., at right angles to the (vertical) direction in which the hook 20 would have to move in order to be separated from the lower connector 16 and also at right angles to the direction in which the upper connector 12 would have to move relative to the hook 20 in order to be separated from the hook 20. The cosine of a right angle is zero. An uplift force on the upper connector 12 therefore has no horizontal component inducing a movement tending to compress the hook 20. Such a force therefore has no tendency to separate the upper connector 12 from the hook 20 or the hook 20 from the lower connector 16.

The hook 20 is therefore securely latched to both the upper and lower connectors 12 and 16 and completely resistant to uplift forces, so long as those forces are not sufficient to tear or severely distort the materials of which the connectors 12 and 16 and hook 20 are made.

Many modifications of the preferred embodiments of the invention will occur to those having ordinary skill in the art. For example, it is within the scope of the invention to interchange the structure at the bottom of the upper connector with the structure at the top of the lower connector and to turn the hook upside down. In that case, the preassembly 30 comprises the hook 20 and lower connector 16, and to form the final assembly 10 the upper connector 12 is lowered onto the preassembly 30 until the hook 20 snaps onto the upper connector 12.

Also, while the preferred embodiment of the invention is the one illustrated, with the flanges being formed on the hook 20 and the slots being formed in the connectors 12 and 16, it is within the scope of the invention to interlock the hook 20 with the connectors 12 and 16 by forming one or more flanges on the connectors and one or more slots in the hook.

The invention extends to all structure and methods that are within the scope of the appended claims.

The invention claimed is:

1. An assembly adapted for use in a building superstructure and comprising:

a first connector adapted for attachment to a first hollow metal log of a said building superstructure, a hook, and a second connector adapted for attachment to a second hollow metal log of the building superstructure, wherein:

the hook is made of a springy material and comprises a pair of spaced-apart, outwardly and oppositely directed horizontal flanges biased outwardly by the springy material, a vertical flange having upper and lower portions, and a contoured structure having a sloping cam surface and a top horizontal surface, the first connector comprises a pair of horizontal slots respectively adapted for preliminary engagement with the horizontal flanges and a vertical slot adapted for preliminary engagement with the upper portion of the vertical flange, the second connector comprises an opening adapted for final engagement with the contoured structure and a vertical slot adapted for final engagement with the lower portion of the vertical flange, the preliminary engagement forms a preassembly, and the final engagement forms a final assembly wherein the first connector, the hook, and the second connector are latched together, and wherein:

during forming of the final assembly, the cam engages the second connector and partly withdraws one of the horizontal flanges from its engaged slot then drops the contoured structure into the opening with the top horizontal surface of the contoured structure opposed to a top edge of the opening, whereby the first and second logs of the building superstructure are interconnected and made resistant to uplift forces.

* * * * *